US010407747B2

(12) United States Patent
Shouji et al.

(10) Patent No.: US 10,407,747 B2
(45) **Date of Patent: *Sep. 10, 2019**

(54) COLD WORKING TOOL MATERIAL AND COLD WORKING TOOL MANUFACTURING METHOD

(71) Applicant: HITACHI METALS, LTD., Tokyo (JP)

(72) Inventors: Tatsuya Shouji, Yasugi (JP); Setsuo Mishima, Yasugi (JP); Yukio Shinji, Yasugi (JP); Katsufumi Kuroda, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/566,812

(22) PCT Filed: Dec. 27, 2016

(86) PCT No.: PCT/JP2016/088883

§ 371 (c)(1),
(2) Date: Oct. 16, 2017

(87) PCT Pub. No.: WO2017/158988

PCT Pub. Date: Sep. 21, 2017

(65) Prior Publication Data

US 2018/0135144 A1 May 17, 2018

(30) Foreign Application Priority Data

Mar. 18, 2016 (JP) ..... 2016-055270
Mar. 24, 2016 (JP) ..... 2016-059965

(51) Int. Cl.
*C21D 6/00* (2006.01)
*C21D 8/00* (2006.01)
(Continued)

(52) U.S. Cl.
CPC ..... *C21D 8/005* (2013.01); *C21D 1/18* (2013.01); *C21D 6/00* (2013.01); *C21D 6/002* (2013.01);
(Continued)

(58) Field of Classification Search
CPC ..... C21D 2211/008; C21D 6/00; C22C 38/00
(Continued)

(56) References Cited

U.S. PATENT DOCUMENTS 9,890,435 B2 * 2/2018 Shouji ..... C22C 37/06
2006/0157163 A1 7/2006 Shimizu et al.
(Continued)

FOREIGN PATENT DOCUMENTS

CN 101487103 A 7/2009
CN 103403207 A 11/2013
(Continued)

OTHER PUBLICATIONS

Communication dated Dec. 27, 2017 from the Korean Intellectual Property Office in counterpart Application No. 10-2017-7026216.
(Continued)

*Primary Examiner* — Jie Yang
(74) *Attorney, Agent, or Firm* — Sughrue Mion, PLLC

(57) ABSTRACT

Provided are a cold working tool material with which high hardness can be obtained in a broad range of tempering temperatures, and a cold working tool manufacturing method using same. The present invention is a cold working tool material comprising a steel component composition that contains, in mass %, C: 0.65-2.40%, Cr: 5.0-15.0%, Mo and W alone or combined (Mo+½W): 0.50-4.00%, V: 0.10-1.50%, and N: greater than 0.0300% to 0.0800%, in which martensitic structure can be adjusted by quenching, and in which, in a 90 μm long 90 μm wide region of a cross-sectional structure that does not contain carbides with
(Continued)

equivalent circle diameters exceeding 5.0 μm, the number density of carbides A with equivalent circle diameters greater than 0.1 μm to 2.0 μm is at least 9.0×105/mm2 and the number density of carbides B with equivalent circle diameters greater than 0.1 μm to 0.4 μm is at least 7.5×105/mm2. The present invention is also a cold working tool manufacturing method in which quenching and tempering are performed on said cold working tool material.

4 Claims, 5 Drawing Sheets

(51) Int. Cl.

| | |
|---|---|
| ***C21D 9/00*** | (2006.01) |
| ***C22C 38/00*** | (2006.01) |
| ***C22C 38/36*** | (2006.01) |
| ***C22C 38/60*** | (2006.01) |
| ***C21D 1/18*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C21D 6/005* (2013.01); *C21D 6/008* (2013.01); *C21D 9/00* (2013.01); *C22C 38/00* (2013.01); *C22C 38/001* (2013.01); *C22C 38/002* (2013.01); *C22C 38/02* (2013.01); *C22C 38/04* (2013.01); *C22C 38/22* (2013.01); *C22C 38/24* (2013.01); *C22C 38/36* (2013.01); *C22C 38/60* (2013.01); *C21D 2211/008* (2013.01)

(58) Field of Classification Search
USPC ..... 148/605
See application file for complete search history.

(56) References Cited

U.S. PATENT DOCUMENTS

| | | | | |
|---|---|---|---|---|
| 2009/0107587 | A1 | 4/2009 | Shimizu | |
| 2017/0327916 | A1* | 11/2017 | Lee | C21D 8/02 |

FOREIGN PATENT DOCUMENTS

| | | | | |
|---|---|---|---|---|
| EP | 2 679 697 | A1 | 1/2014 | |
| JP | 05-156407 | A | 6/1993 | |
| JP | 2000-073142 | A | 3/2000 | |
| JP | 2005-226150 | A | 8/2005 | |
| JP | 2005-325407 | A | 11/2005 | |
| JP | 2006-193790 | A | 7/2006 | |
| JP | 2010-007167 | A | 1/2010 | |
| JP | 2012-214833 | A | 11/2012 | |
| JP | 2014-145100 | A | 8/2014 | |
| JP | 2016-069728 | A | 5/2016 | |
| KR | 10-2009-0045093 | A | 5/2009 | |
| WO | 2012/115025 | A1 | 8/2012 | |
| WO | 2015/182586 | A1 | 12/2015 | |
| WO | 2016/047396 | A1 | 3/2016 | |
| WO | WO-2016085203 | A1 * | 6/2016 | C21D 8/02 |

OTHER PUBLICATIONS

"JIS-G-4404 (2006) Alloy Tool Steel Material", JIS Handbook (1) Iron and Steel I, Japanese Standards Association, Jan. 23, 2013, pp. 1652-1663.

International Search Report of PCT/JP2016/088883 dated Apr. 4, 2017 [PCT/ISA/210].

Written Opinion of PCT/JP2016/088883 dated Apr. 4, 2017 [PCT/ISA/237].

Extended European Search Report dated Apr. 4, 2018 issued by the European Patent Office in counterpart European application No. 16894605.1.

* cited by examiner

COLD WORKING TOOL MATERIAL AND COLD WORKING TOOL MANUFACTURING METHOD

CROSS REFERENCE TO RELATED APPLICATIONS

This application is a National Stage of International Application No. PCT/JP2016/088883, filed Dec. 27, 2016 (claiming priority based on Japanese Patent Application No. 2016-055270, filed Mar. 18, 2016, and Japanese Patent Application No. 2016-059965, filed Mar. 24, 2016), the contents of which are incorporated herein by reference in their entirety.

TECHNICAL FIELD

The present invention relates to a cold work tool material suitable for various kinds of cold work tools such as press dies, forging dies, rolling dies or metal cutting tools. The present invention also relates to a method of manufacturing the cold work tool with use of the cold work tool material.

BACKGROUND ART

Since a cold work tool is used in contact with a hard workpiece, the tool is required to have a sufficient hardness to resist the contact. Conventionally, alloy tool steels of the SKD10 or SKD11 series for example, which are JIS steel grades, have been used for cold work tool materials (see Non Patent Literature 1). Furthermore, an alloy tool steel having an improved composition from the above alloy tool steels has been proposed in response to demands for further increased hardness (see Patent Literature 1).

Typically, a cold work tool material is manufactured from a raw material, as a starting material, such as a steel ingot or a bloom which is produced from the ingot. The starting material is subjected to various hot working and heat treatment to form a predetermined steel material, and then the steel material is subjected to an annealing process to produce the cold work tool material. The cold work tool material in the annealed condition having a low hardness is typically supplied to a manufacturer of a cold work tool. The material is machined into a shape of the tool, and thereafter quenched and tempered to adjust its hardness for use. After the adjustment of the hardness, finishing machining is typically conducted. In some cases, quenching and tempering are conducted first for the material in the annealed condition, and then the machining is conducted for the tool shaping together with the finishing machining. Here, the term "quenching" refers to an operation where a cold work tool material (or a cold work tool material that has been subjected to machining) is heated in an austenitic phase temperature range and then rapidly cooled to transform it into a martensitic structure. Thus, the cold work tool material has such a composition that can have a martensitic structure by the quenching.

In this connection, it has been known that a hardness of a cold work tool can be improved by controlling a martensitic structure after quenched. For example, techniques for adjusting an amount of retained austenite in a matrix after quenched (see Patent Literature 2), and techniques for adjusting an amount of chromium or molybdenum dissolved in the matrix after quenched (see Patent Literatures 3 and 4) were proposed.

CITATION LIST

Patent Literature

Patent Literature 1: JP-A-05-156407
Patent Literature 2: JP-A-2000-73142
Patent Literature 3: JP-A-2005-325407
Patent Literature 4: JP-A-2014-145100

Non Patent Literature

Non Patent Literature 1: "JIS-G-4404 (2006) Alloy Tool Steel Material", JIS Handbook (1) Iron and Steel I, Japanese Standards Association, Jan. 23, 2013, pages 1652-1663

SUMMARY OF INVENTION

Indeed the cold work tool materials of Patent Literatures 2 to 4 can have improved hardness after quenched and tempered. However, change of a tempering temperature brought about a low hardness in some cases. Thus, a high hardness was not obtained over a wide range of the tempering temperature. The tempering temperature is determined not only by the hardness of the cold work tool, but also from a viewpoint of a dimensional change during a heat treatment or adjustment of an amount of retained austenite. Hence, it is advantageous for the cold work tool material to obtain of a high hardness over a wide range of the tempering temperature since the tempering temperature can be selected from an extended range.

An objective of the present invention is to provide a cold work tool material for which a high hardness is obtained over a wide range of tempering temperature, and a method of manufacturing a cold work tool from the cold work tool material.

The present invention relates to a cold work tool material having a steel composition including, by mass %, C: 0.65% to 2.40%, Cr: 5.0% to 15.0%, Mo and W alone or in combination in an amount of (Mo+½W): 0.50% to 4.00%, V: 0.10% to 1.50%, and N: more than 0.0300% and not more than 0.0800%, the steel composition being adjusted such that the material has a martensitic structure by quenching, wherein the material includes a cross sectional region of a structure, the region having a length of 90 μm and a width of 90 μm and including no carbides having an equivalent circular diameter exceeding 5.0 and wherein, in the cross sectional region, a number density of carbides A having an equivalent circular diameter of more than 0.1 μm and not more than 2.0 μm is not less than $9.0*10^5/mm^2$, and a number density of carbides B having an equivalent circular diameter of more than 0.1 μm and not more than 0.4 μm is not less than $7.5*10^5/mm^2$.

In an embodiment, the cold work tool material preferably has the steel composition including, by mass %, C: 0.65% to 2.40%, Cr: 5.0% to 15.0%, Mo and W alone or in combination in the amount of (Mo+½W): 0.50% to 4.00%, V: 0.10% to 1.50%, N: more than 0.0300% and not more than 0.0800%, Si: not more than 2.00%, Mn: not more than 1.50%, P: not more than 0.050%, S: not more than 0.0500%, Ni: 0% to 1.00% and Nb: 0% to 1.50%, and the balance being Fe and an impurities.

In an embodiment, the cold work tool material preferably has, in the above-described region having the length of 90 μm and the width of 90 μm, a proportion of the number of the carbides B to the number of the carbides A is not less than 65.0%.

The present invention also provides a method of manufacturing a cold work tool, including a step of quenching and tempering the cold work tool material of the present invention.

According to the present invention, a high hardness is obtained over a wide range of tempering temperature for the cold work tool material.

DESCRIPTION OF EMBODIMENTS

Figure 1:
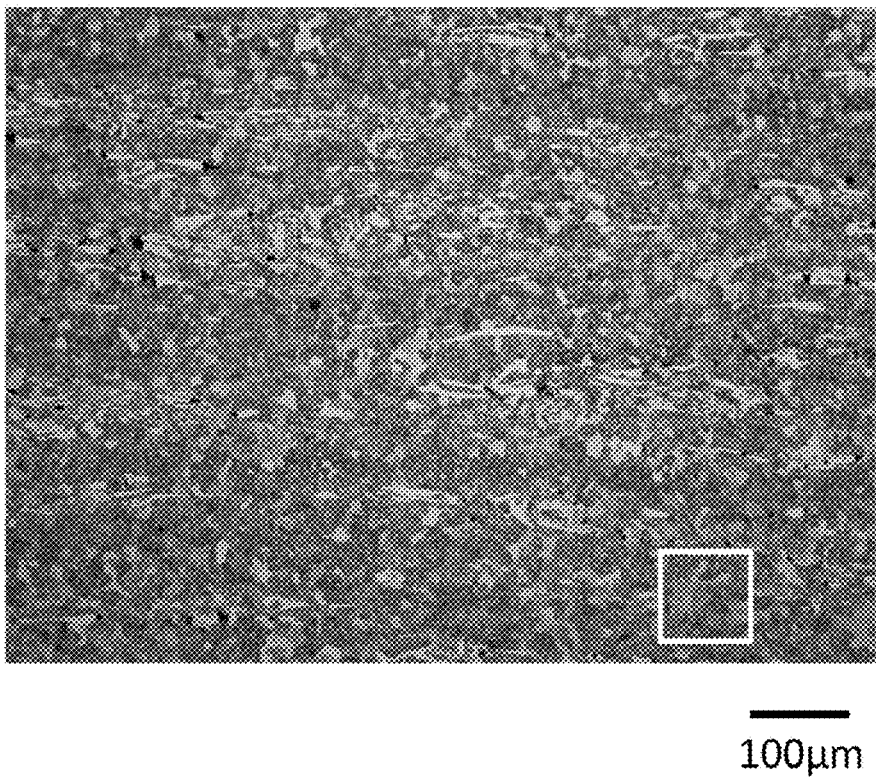
FIG. 1 is an optical microscope photograph illustrating an example of a cross-sectional structure of the cold work tool material of the present invention.

The inventors investigated a structure of a cold work tool material to find factors that influence on a hardness of a quenched and tempered material. As a result, they discovered that, among carbides existing in the structure, a distribution of "solid solution carbides" that are to be solid-solved in a matrix at the time of the subsequent quenching process significantly influences on the hardness after quenching and tempering. Then, the inventors found that a high hardness can be obtained over a wide range of a tempering temperature, not at a limited tempering temperature, by means of adjusting the distribution of the solid solution carbides, thereby achieved the present invention. Each component of the present invention is described below.

(1) The cold work tool material of the present invention is used after quenched and tempered and has a structure including carbides:

The cold work tool material of the present invention has a structure including carbides so that the material obtains high hardness even it is tempered in a wide range of tempering temperatures in quenching and tempering process. The structure is, for example, an annealed structure. The term "annealed structure" means a structure produced by an annealing process (for example, the annealing conducted at 750° C. to 900° C.), and preferably softened to e.g. about 150 HBW to about 255 HBW in Brinell hardness. In general, the annealed structure is constituted of a ferrite phase or a ferrite phase with pearlite or cementite ($Fe_3C$). Typically, the annealed structure of a cold work tool material includes carbides composed of carbon bonded with Cr, Mo, W or V or the like. The carbides include "non-solid solution carbides" that are not solid-solved in a matrix during the quenching in the subsequent process, and "solid solution carbides" that are solid-solved in the matrix during the quenching process.

(2) The cold work tool material of the present invention has a steel composition including, by mass %, C: 0.65% to 2.40%, Cr: 5.0% to 15.0%, Mo and W alone or in combination in an amount of (Mo+½W): 0.50% to 4.00%, V: 0.10 to 1.50%, and N: more than 0.0300% and not more than 0.0800%, and the steel composition is adjusted such that the material has a martensitic structure by the quenching.

The cold work tool material is typically produced from a raw material of a steel ingot or a billet that is bloomed from the ingot, as a starting material. The raw material are subjected to various hot working and heat treatment to form a predetermined steel material, and then to annealing process, thereby finished into a block shape. As described above, a raw material that transforms into a martensitic structure by quenching and tempering is conventionally used for the cold work tool material. The martensitic structure is necessary to establish basic mechanical properties of various cold work tools. As typical cold work tool material, various kinds of cold work tool steels, for example, are known. The cold work tool steels are generally used in an environment where a surface temperature thereof is not higher than approximately 200° C. A standard steel grades in JIS-G-4404 "alloy tool steels" for example, or other compositions which have been proposed can be applied to these cold work tool steels. In addition, other elements that are not included in the above cold work tool steels can also be added as necessary.

The effect that "a high hardness can be obtained over a wide range of tempering temperature" (hereunder, referred to as "hardness stability effect") can be achieved if the structure of the cold work tool material generates the martensitic structure through quenching and tempering, as far as the structure satisfies the requirement (3) described later, and preferably the requirement (4). In order to obtain the hardness stability effect of the present invention at a high level, it is effective to determine a content of N (nitrogen) in addition to contents of carbide-forming elements C, Cr, Mo, W and V, which contribute to improvement of an "absolute value" of the hardness of the cold work tool, among the elements in the steel composition that allows to generate the martensitic structure. Specifically, the composition includes, by mass %, C: 0.65% to 2.40%, Cr: 5.0% to 15.0%, Mo and W alone or in combination in an amount of (Mo+½W): 0.50% to 4.00%, V: 0.10 to 1.50% and N: more than 0.0300% and not more than 0.0800%.

By increasing the absolute value of the hardness of the cold work tool, the "hardness stability effect" acts synergistically therewith, thereby the cold work tool can obtain excellent mechanical properties of both "high hardness" and "stable degree of hardness". Elements constituting the composition of the cold work tool material of the present invention are explained below.

C: 0.65% to 2.40% by Mass (Hereunder, Expressed Simply as "%")

C (carbon) is a basic element of a cold work tool material. Carbon partially solid-solves in a matrix to provide a hardness thereto, and partially forms carbides to improve a wear resistance and a galling resistance. Also, solid solved carbon as an interstitial atom is expected to exhibit an I (interstitial atom)-S (substitutional atom) effect (carbon acts as drag resistance for solute atoms, and acts to enhance a strength of the cold work tool), if is added together with a substitutional atom having a high affinity with carbon, such as Cr. However, an excessive addition will cause deterioration of toughness due to an excessive increase in non-solid-solved carbides. Therefore, the carbon content is determined to be 0.65% to 2.40%. Preferably, the content is not less than 0.80%, more preferably, not less than 1.00%, further more preferably not less than 1.30%. Furthermore, the content is preferably not more than 2.10%, more preferably not more than 1.80%, further more preferably not more than 1.60%.

Cr: 5.0% to 15.0%

Cr (chromium) is an element that increases hardenability. Furthermore, Cr forms carbides to improve wear resistance. Cr also contributes to improve resistance to temper softening, and is a basic element of a cold work tool material. However, an excessive addition will cause formation of coarse non-solid-solved carbides and lead to a deterioration in toughness. Therefore, the Cr content is determined to be 5.0% to 15.0%. The content is preferably not more than 14.0%, more preferably not more than 13.0%. Furthermore, the content is preferably not less than 7.0%, more preferably not less than 9.0%, further more preferably not less than 10.0%.

Mo and W Alone or in Combination in an Amount of (Mo+½W): 0.50% to 4.00%

Mo (molybdenum) and W (tungsten) cause fine carbides to precipitate or aggregate through tempering, thereby providing strength to a cold work tool. Mo and W can be added alone or in combination. An amount of addition can be specified by a Mo equivalent that is defined by a formula (Mo+½W), since an atomic weight of W is approximately twice that of Mo. Of course, only either one of them may be added or both may be added. To achieve the above effects, the amount of addition is not less than 0.50% in terms of the value of (Mo+½W). Preferably, the amount is not less than 0.60%. Since an excessive addition will cause deterioration of machinability and toughness, the amount is not more than 4.00% in terms of the value of (Mo+½W). The amount is preferably not more than 3.00%, more preferably not more than 2.00%, further more preferably not more than 1.50%, particularly preferably not more than 1.00%.

V: 0.10% to 1.50%

V (vanadium) forms carbides and thus has effects of strengthening a matrix and improving wear resistance and resistance to temper softening. Furthermore, vanadium carbides distributed in a structure function as "pinning particles" that suppress coarsening of austenite grains during heating for quenching, and thereby also contribute to improve toughness. To achieve the effects, an amount of addition of V is not less than 0.10%, preferably not less than 0.20%, more preferably not less than 0.40%. Furthermore, in order to act as solid solution carbides (described later) according to the present invention, not less than 0.60% of V may be added. However, since an excessive addition will cause deterioration of machinability as well as deterioration of toughness due to an increase in the carbides, the V content is not more than 1.50%, preferably not more than 1.00%, more preferably not more than 0.90%.

N: More than 0.0300% and not More than 0.0800%

N (nitrogen) is an element that enhances wear resistance and galling resistance by precipitating fine carbides or carbonitrides, when it is added together with substitutional element/elements such as Cr or V having a high affinity with N. However, excessive addition may cause deterioration of toughness due to increase of coarse nitrides or carbonitrides. Therefore, the nitrogen content is determined to be more than 0.0300% but not more than 0.0800%. Preferably, the content is not less than 0.0310%, more preferably not less than 0.0320%, still more preferably not less than 0.0330%, and particularly preferably not less than 0.0340%. Furthermore, the content is preferably not more than 0.0700%, more preferably not more than 0.0600%, still more preferably not more than 0.0500%, and particularly preferably not more than 0.0400%.

The cold work tool material of the present invention may have the composition including the above elements. A composition may include the above elements and the balance of iron and inevitable impurities. In addition to the above elements, the material may further include one or more of following elements.

Si: Not More than 2.00%

Si (silicon) is a deoxidizer in a melting process. An excessive addition of Si decreases hardenability. Furthermore, toughness of a cold work tool after quenched and tempered also decreases. Thus, the Si content is preferably not more than 2.00%, more preferably not more than 1.50%, further more preferably not more than 0.80%. On the other hand, Si solid-solves in a structure of the cold work tool, and has an effect of enhancing hardness of the tool. To obtain the effects, an amount of Si is preferable not less than 0.10%, more preferably not less than 0.30%.

Mn: Not More than 1.50%

Excessive addition of Mn (manganese) increases ductility of a matrix, thereby decreasing machinability of the material. Hence, an amount of Mn is preferably not more than 1.50%, more preferably not more than 1.00%, further more preferably not more than 0.70%. On the other hand, since Mn is an austenite-forming element, it has an effect of increasing hardenability. Moreover, Mn has a large effect on improving machinability since it forms a non-metallic inclusion MnS. To achieve the effects, addition of Mn is preferably not less than 0.10%, more preferably not less than 0.20%.

P: Not More than 0.050%

P (phosphorous) is normally included inevitably in various kinds of cold work tool materials, even though it is not added. Phosphorous segregates in prior austenite grain boundaries during a heat treatment, such as tempering, thereby making the grain boundaries brittle. Therefore, an amount of phosphorous is limited to not more than 0.050% to improve toughness of the cold work tool, including a case where phosphorous P is added. More preferably, the amount is not more than 0.030%.

S: Not More than 0.0500%

S (sulfur) may be normally included inevitably in various kinds of cold work tool materials, even though it is not added. Sulfur deteriorates hot workability of the material before hot working, and produces cracks during the hot working. Therefore, it is preferable to limit an amount of sulfur to not more than 0.0500% to improve the hot workability of the material. The sulfur content is more preferably not more than 0.0300%, further more preferably less than 0.0100%. On the other hand, sulfur has an effect of improving machinability by bonding with Mn to form a non-metallic inclusion MnS. In order to obtain the effect, the content may excess 0.0300%.

Ni: 0 to 1.00%

Ni (nickel) increases ductility of a matrix, thereby decreasing machinability. Thus, the Ni content is preferably limited to not more than 1.00%, more preferably not more than 0.80%, further more preferably less than 0.50%, particularly preferably less than 0.30%. The Ni content of less than 0.30% also indicates an upper limit of Ni in a case where Ni is included as an impurity (including the case where the Ni content is "0%").

On the other hand, Ni suppresses generation of ferrite in the tool structure. Moreover, Ni is effective in providing excellent hardenability to the cold work tool material, and enables formation of a structure mainly composed of martensite, even when a cooling rate in quenching is not so rapid, to prevent deterioration of toughness. Furthermore, since Ni also improves intrinsic toughness of the matrix, Ni may be added according to need according to the present invention. In order to obtain these effects, the Ni content is preferably not less than 0.10% and does not exceed the upper limit 1.00%. More preferably, the Ni content is not less than 0.30%.

Nb: 0 to 1.50%

Nb (niobium) causes deterioration of machinability, and thus an amount of Nb is preferably not more than 1.50%, more preferably not more than 1.00%, further more preferably not more than 0.90%, particularly preferably less than 0.30%. The amount of less than 0.30% of Nb indicates an upper limit of Nb in a case where Nb is included as an impurity (including the case where the Nb content is "0%").

On the other hand, Nb forms carbides and has effects of strengthening a matrix and improving wear resistance. Moreover, Nb increases resistance to temper softening. Nb also has an effect of suppressing coarsening of grains, similarly to V, thereby contributing to improve toughness. Thus, Nb may be added according to need. In order to obtain the effect, the Nb content is preferably not less than 0.10% and does not exceed the upper limit 1.50%. The amount is more preferably not less than 0.30%.

Cu, Al, Ti, Ca, Mg and O (oxygen) are elements which may possibly remain in a steel as inevitable impurities. It is preferable to limit an amount of the elements as low as possible in the cold work tool material of the present invention. On the other hand, small amounts of the elements may be added to effectively obtain additional effects such as morphology control of inclusions, or improvements of other mechanical properties and productivity. In the case, following ranges are permissible: Cu≤0.25%; Al≤0.25%; Ti≤0.0300%; Ca≤0.0100%; Mg≤0.0100%; and O≤0.0100%. These are preferable upper limits of the elements according to the present invention.

Al is an element that is useful as a deoxidizer in steel manufacture. However, if Al is added excessively in a cold work tool material including coexisting nitrogen, a large amount of coarse aluminum nitride (AlN)-based inclusions may precipitate in the material. When the cold work tool material is processed into a shape of a cold work tool, a surface of the material is often subjected to "electrical discharge machining". The AlN-based inclusions hardly conduct electricity. Thus, if such a large amount of coarse AlN-based inclusions is included in the material, abnormal discharge or the like may occur at a portion where the AlN-based inclusions are precipitated, during the electrical discharge machining, and processed surface by the electrical discharge machining may be considerably deteriorated, which may lead to degradation of the electrical discharge machinability. Furthermore, since nitrogen is fixed as the AlN-based inclusions, an effect expected by nitrogen of the present invention may be reduced. Thus, the Al content is more preferably less than 0.01%, further preferably not more than 0.008%, still more preferably not more than 0.006%, and particularly preferably not more than 0.004%. A lower limit of Al is preferably not less than 0.0005%, more preferably not less than 0.0008%, and still more preferably not less than 0.001%.

(3) The material includes a cross sectional region of an annealed structure, the region having a length of 90 μm and a width of 90 μm and including no carbides having an equivalent circular diameter exceeding 5.0 μm, and in the cross sectional region, a number density of carbides A having an equivalent circular diameter of more than 0.1 μm and not more than 2.0 μm is not less than $9.0*10^5/mm^2$, and a number density of carbides B having an equivalent circular diameter of more than 0.1 μm and not more than 0.4 μm is not less than $7.5*10^5/mm^2$.

The cold work tool material is typically produced from a raw material of a steel ingot or a bloom (bloomed from the ingot) as a starting material, through various hot working and heat treatment to form a predetermined steel material, and then through annealing process on the steel material, thereby finishing into a block shape. The ingot is typically produced by casting a molten steel that is adjusted to have a predetermined composition. The ingot has a structure including portions where large carbides aggregate and portions where smaller carbides aggregate (so-called "negative segregation" part), due to difference of starting timing of solidification (or due to difference of dendrite growth).

When the ingot is hot worked, the aggregates of carbides are extended along an extending direction of the hot working (that is, a longitudinal direction of the material), and are compressed in a vertical direction thereof (that is, a thickness direction of the material). When the hot worked steel is annealed, the structure of the cold work tool material has a carbides distribution that is a substantially laminate composed of layers of aggregates of large carbides and layers of aggregates of small carbides (see FIG. 1). In FIG. 1, carbides are seen as "light-colored dispersions" extended in stripe in a dark-colored matrix.

The large carbides in the structure function mainly as "non-solid solution carbides" that are not solid-solved in a matrix during heating for quenching, and remain in the structure after quenching and tempering and thereby contribute to improving the wear resistance of the cold work tool. The small carbides function as "solid solved carbides", that are liable to be solid-solved in the matrix during the heating for quenching. The carbides solid-solved in the matrix increase an amount of solid solved carbon in the matrix after quenching and tempering, and thereby increase hardness of the cold work tool. In the present invention, carbides having an equivalent circular diameter exceeding 5.0 μm in a cross-section of the structure are deemed as non-solid solution carbides, and a region of "a length of 90

μm and a width of 90 μm" including only "solid solution carbides" having an equivalent circular diameter of not more than 5.0 μm is noted (for example, see a portion surrounded by a solid line in FIG. 1). That is, the region of "a length of 90 μm and a width of 90 μm" corresponds to a region of a "layer of aggregates of small carbides". It was discovered that the carbide distribution in this region can be utilized for the "hardness stability effect" of the present invention.

The inventors investigated an influence of the carbides having an equivalent circular diameter of not more than 5.0 μm on hardness of the cold work tool after quenched and tempered. As a result, they found that, among such carbides, carbides having a further smaller equivalent circular diameter of "not more than 2.0 μm" (hereunder, referred to as "carbides A") are more liable to be solid-solved. They also found that, extremely fine carbides having an equivalent circular diameter of "not more than 0.4 μm" (hereunder, referred to as "carbides B") are particularly liable to be solid-solved. They further found that the small carbides can be uniformly distributed in the structure by controlling a casting process or the like when producing the steel ingot. If easily-solid-solved carbides are distributed uniformly in the structure before quenched or tempered, an amount of solid-solved carbon in the structure of the cold work tool after quenched and tempered can be increased uniformly as a whole. As a result, an absolute value of the hardness can be increased, and even if the tempering temperature is changed, a high hardness can be obtained.

Therefore, it is effective for obtaining the "hardness stability effect" of the present invention to increase a number of carbides A having an equivalent circular diameter of not more than 2.0 and furthermore increase a number of carbides B having an equivalent circular diameter of not more than 0.4 μm among the carbides A in a region that does not include carbides having an equivalent circular diameter exceeding 5.0 According to the present invention, the "hardness stability effect" can be achieved by a structure in which the number density of the carbides A having the equivalent circular diameter of more than 0.1 μm and not more than 2.0 μm is not less than $9.0*10^5/mm^2$, and the number density of the carbides B having the equivalent circular diameter of more than 0.1 μm and not more than 0.4 μm is not less than $7.5*10^5/mm^2$, in the region of a length of 90 μm and a width of 90 μm. The lower limit of the equivalent circular diameter of both carbides A and B is defined to be 0.1 μm since the carbides having an equivalent circular diameter of not more than 0.1 μm can not be measured with accuracy.

The number density of the carbides A is more preferably not less than $9.5*10^5$ per $mm^2$, further more preferably not less than $10.0*10^5$ per $mm^2$. Particularly preferably, the number density is not less than $11.0*10^5$ per $mm^2$. The number density of the carbides B is more preferably not less than $8.0*10^5$ per $mm^2$, further more preferably not less than $8.5*10^5$ per $mm^2$. Particularly preferably, the number density is not less than $9.0*10^5$ per $mm^2$. Please note that the number density of the carbides B does not exceed the number density of the carbides A. Although upper limits of the number densities of the carbides A and B are not defined particularly, the upper limit of the number density of the carbides A is realistically about $20.0*10^5/mm^2$, and the upper limit of the number density of the carbides B is realistically about $19.0*10^5/mm^2$. Moreover, a proportion of the number of the carbides B to the number of the carbides A, which will be described below, will be realistically not more than 95.0%.

(4) Preferably, in the cross sectional region having the length of 90 μm and the width of 90 μm, a proportion of the number of the carbides B to the number of the carbides A is more than 60.0%.

It is more advantageous for achieving the "hardness stability effect" of the present invention to include the greater number of the carbides B having a smaller equivalent circular diameter (that is, more likely to be solid-solved) among the fine carbides A and B, as stated in the item (3), distributed in the region in which there are no carbides having an equivalent circular diameter of more than 5.0 μm. It is more effective in the present invention if the proportion of the number of the carbides B to the number of the carbides A exceeds 60.0%. The proportion is preferably not less than 65.0%, further preferably not less than 70.0%, and still more preferably not less than 80.0%. An upper limit of this proportion is not defined particularly, but is realistically not more than 95.0%.

Here, an example of a method for measuring the equivalent circular diameter and the number (number density) of the carbides A and B is described below.

First, a cross-sectional structure of the cold work tool material is observed with an optical microscope with a magnification of 200 times, for example. The observed cross section may be taken from a center portion of a cold work tool material for the cold work tool. The cross-section to be observed is parallel to an extending direction of the hot working (that is, a longitudinal direction of the material), specifically, a cross-section (so-called "TD cross-section") that is perpendicular to a TD direction (transverse direction) among the above parallel cross-section. Herein, if a shape of the cold work tool material is "cylindrical", the TD face is defined as a cross section that is in parallel to a longitudinal axis of the cylindrical shape. This cross-section having an area of 15 mm*15 mm for example may be polished to a mirror surface by means of a diamond slurry and colloidal silica. FIG. 1 shows an optical microscope photograph (field-of-view area: 0.58 $mm^2$) at a magnification of 200 times of a cross-sectional structure obtained with the above procedures for an example of the cold work tool material of the present invention (that is, "cold work tool material 1" as an example of the present invention in the Examples).

Then, a region of a length of 90 μm and a width of 90 μm that does not include carbides having an equivalent circular diameter exceeding 5.0 μm is selected from the cross-sectional structure. At this time, large carbides having an equivalent circular diameter exceeding 5.0 μm can be easily observed from the field of view of the optical microscope (see FIG. 1). The equivalent circular diameter of the observed carbides can be determined by means of known image analysis software or the like.

Next, the selected region having a length of 90 μm and a width of 90 μm (see a portion surrounded by a solid line in FIG. 1) is observed with a scanning electron microscope (magnification of 3000 times), and the observed field is analyzed with an EPMA to obtain an elemental mapping image of carbon. Subsequently, a binarizing process is conducted with a threshold of not less than 50 counts (cps) of a detected intensity of carbon on an analysis result of the elemental mapping image of carbon, based on an amount of carbon forming carbides. Thus, a binary image showing carbides that are distributed in the matrix of the cross-sectional structure is obtained.

Figure 2:
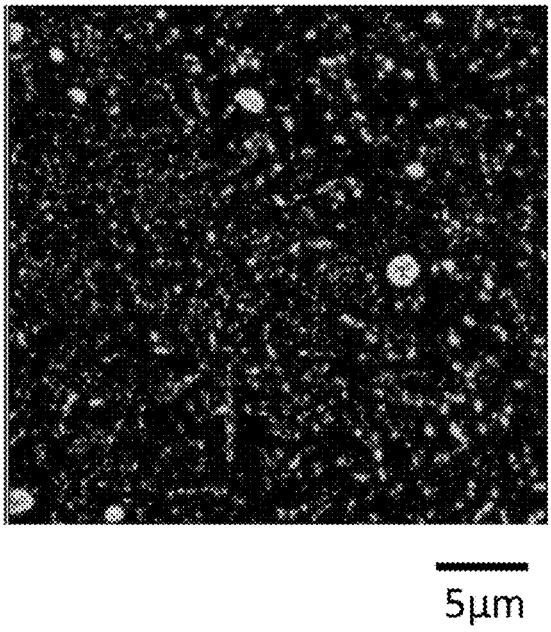
FIG. 2 is a view illustrating an elemental mapping image of C (carbon) of a region that does not include carbides having an equivalent circular diameter exceeding 5.0 μm when analyzed by means of an EPMA (electron probe microanalyzer), as an example of a cross-sectional structure of the cold work tool material of the present invention.
Figure 3:
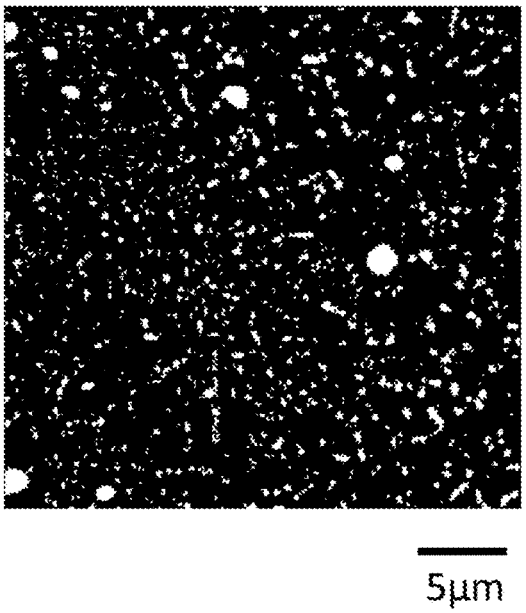
FIG. 3 is a view illustrating a binary image of FIG. 2 based on an amount of carbon that forms carbides.

FIG. 2 shows an elemental mapping image of carbon (field-of-view area: 30 μm*30 μm) obtained by the above procedures for the region surrounded by a solid line in FIG. 1. FIG. 3 is a view illustrating a carbide distribution in the region, which is obtained by the binarizing process for FIG. 2. In FIGS. 2 and 3, carbon and carbides are shown with a light-colored distribution.

From the carbide distribution in FIG. 3 that "does not include carbides having an equivalent circular diameter exceeding 5.0 μm", carbides having respective equivalent circular diameters can be counted, and thus the above numbers of carbides A and B as well as the proportion between the numbers of carbides A and B can be determined. The equivalent circular diameters and the numbers of the carbides can be determined by means of known image analysis software or the like.

In the case of the cold work tool material of the present invention, small carbides having an equivalent circular diameter of not more than 2.0 μm are distributed with a substantially uniform number density (see FIG. 3) in a region of the length of 90 μm and width of 90 μm in "a layer of aggregates of small carbides". Thus, only a single elemental mapping image with an area of 30 μm*30 μm (number of pixels: 530*530) is sufficient for confirming the "hardness stability effect" of the present invention, when the image is selected from the above described region having a length of 90 μm and a width of 90 μm. Furthermore, a position of the elemental mapping image may be arbitrarily selected from the above region. If the series of measurement is conducted for at least two other regions having "a length of 90 μm and a width of 90 μm" separate from the above region having "a length of 90 μm and a width of 90 μm" (that is, a total of three regions) and the results of the above-described values obtained from the elemental mapping images for an area of "30 μm*30 μm" of each of the three regions are summed, the "hardness stability effect" of the present invention can be sufficiently confirmed.

The structure of the cold work tool material of the present invention can be obtained by appropriately controlling a solidification process in a step of producing a steel ingot as the starting material. For example, it is important to adjust a "temperature of a molten steel" immediately prior to pouring it in a casting mold. A temperature of the molten steel is controlled at a lower temperature, for example, in a temperature range up to a temperature of a melting point of the cold work tool material+about 100° C. Thereby, local concentration of the constituents in the molten steel due to differences between solidification starting timing at different positions in the mold can be reduced, and coarsening of carbides that is caused by growth of dendrite can be suppressed. Furthermore, for example, the molten steel cast in the mold is cooled so that it quickly passes a solid-liquid coexisting temperature zone, for example, by cooling within 60 minutes. Thereby, coarsening of crystallized carbides can be suppressed.

Subsequent to the above solidification process, a cooling process of a solidified steel ingot can be preferably controlled such that the fine carbides in the cold work tool material of the present invention can be further increased. These fine carbides are precipitated in the region of the negative segregation, that is, in dendrites of the steel ingot after solidification. When a cooling rate in a precipitation temperature range after the solidification is increased, the fine carbides can be increased since nucleation for the precipitation can be increased. In the cold work tool material of the present invention, this precipitation temperature range is from the solidification completing temperature of the steel ingot (that is typically lower than the "melting point") to about 800° C., in which carbides are stably precipitated. Thus, it is effective to increase the fine carbides to cool the ingot e.g. within 70 minutes from the solidification completing temperature of the ingot to 800° C.

(5) A method of manufacturing a cold work tool, comprising a step of quenching and tempering the above cold work tool material The above cold work tool material of the present invention is adjusted to have a martensitic structure having a predetermined hardness by quenching and tempering, and made into a cold work tool product. The cold work tool material is made into a shape of the tool by various machining such as cutting, boring, electrical discharge machining or the like. This machining is preferably conducted when the material has low hardness (for example, in an annealed state) before quenched and tempered. In this case, finishing machining may be further conducted after quenched and tempered. Alternatively, in some cases, a material in a state of prehardened steel which has been subjected to quenching and tempering may be machined into a shape of a cold work tool together with the finishing machining.

Temperatures of the quenching and the tempering differ depending on compositions of the material or target hardness or the like. Preferably, the quenching temperature is approximately 950° C. to 1100° C., and the tempering temperature is approximately 150° C. to 600° C. In a case of SKD10 or SKD11 for example, which are representative steel grades of cold work tool steels, the quenching temperature is approximately 1000° C. to 1050° C. and the tempering temperature is approximately 180° C. to 540° C. A hardness of the quenched and tempered material is preferably not less than 58 HRC, and more preferably not less than 60 HRC. While an upper limit of the quenching and tempering hardness is not particularly defined, a hardness of not more than 66 HRC is realistic.

Example 1

Materials 1 to 3 having compositions shown in Table 1 were produced by casting molten steels (melting point: about 1400° C., solidification completing temperature: about 1200° C.) which had been adjusted to have the predetermined compositions. Herein, each molten steel of the materials 1 to 3 were adjusted to have a temperature 1500° C. before poured into a casting mold. Cooling time periods passing a solid-liquid coexisting range after pouring the materials 1 to 3 into the casting molds were adjusted to 28 minutes for the materials 1 and 2, and 168 minutes for the material 3, by changing the dimensions of the casting molds for the materials 1 to 3. Furthermore, cooling time periods of the solidified steel ingots (the materials) passing a temperature range from the solidification completing temperature to 800° C. were adjusted to 53 minutes for the materials 1 and 2 and 267 minutes for the material 3.

Please note that the materials 1 to 3 correspond to cold work tool steel SKD10 in accordance with a standard steel grade of JIS-G-4404. Cu, Al, Ti, Ca, Mg and O were not intentionally added to the materials 1 to 3 (while Al was used as a deoxidizer in a melting process). The contents of the elements were Cu≤0.25%; Al≤0.25%; Ti≤0.0300%; Ca≤0.0100%; Mg≤0.0100%; and O≤0.0100%. The Al content in the materials 1 to 3 were 0.002%.

TABLE 1

| Material | C | Si | Mn | P | S | Cr | Mo | V | N | by mass % Fe* |
|---|---|---|---|---|---|---|---|---|---|---|
| 1 | 1.41 | 0.53 | 0.42 | 0.021 | 0.0002 | 11.7 | 0.73 | 0.72 | 0.0335 | Bal. |
| 2 | 1.44 | 0.45 | 0.42 | 0.024 | 0.0005 | 11.7 | 0.75 | 0.73 | 0.0325 | Bal. |
| 3 | 1.51 | 0.23 | 0.28 | 0.020 | 0.0096 | 12.0 | 0.77 | 0.78 | 0.0112 | Bal. |

*Impurities are included.

Next, these materials were heated at 1160° C. and hot-worked. The hot-worked materials were allowed to be cooled, thereby obtaining steels 1 to 3, which correspond to the materials 1 to 3 respectively, having dimensions shown in Table 2. (A length direction of each steel in Table 2 was an extended direction by the hot working). Then, the steels were annealed at 860° C., thereby producing the cold work tool materials 1 to 3 (hardness: 240 HBW) which correspond to the steels 1 to 3 respectively.

TABLE 2

| Steels | Dimension (mm) |
|---|---|
| 1 | thickness: 75, width: 630, length: 1000 |
| 2 | diameter: 147, length: 1000 |
| 3 | thickness: 60, width: 500, length: 1000 |

A cut section having a cross-sectional area of 15 mm*15 mm was taken from a TD face at a center portion of each of the cold work tool materials 1 to 3. The TD face is parallel to the direction extended by the hot working (that is, the length direction of the material). For the cold work tool material 2, the cut section was taken from a TD face positioned at ¼ of a diameter from the circumferential surface toward its center. The cut section was polished into a mirror surface with use of diamond slurry and colloidal silica. Next, three regions, each having a length of 90 μm and a width of 90 μm which include no carbide having an equivalent circular diameter of more than 5.0 μm, were extracted from the structure of each polished cut section. FIG. 1 shows an example of the region in the cold work tool material 1 (see a portion surrounded by a solid line).

For each region, the number of carbides A having an equivalent circular diameter more than 0.1 μm and not more than 2.0 μm, the number of carbides B having an equivalent circular diameter more than 0.1 μm and not more than 0.4 μm, and a proportion of the number of carbides B to the number of carbides A were determined in accordance with the above described means. An open source image processing software program "ImageJ" (http://imageJ.nih.gov/ij/) supplied from the National Institutes of Health (NIH) was used for image processing and analysis for determining the equivalent circular diameter and the number of the carbides. FIG. 2 illustrates an elemental mapping image of carbon in the region of the cold work tool material 1. A field-of-view area in FIG. 2 has a size of 30 μm*30 μm. This field of view is a center section of nine sections when the region with a length of 90 μm and a width of 90 μm was divided into the nine sections by trisecting the length and the width respectively. FIG. 3 shows a binary image for the elemental mapping image in FIG. 2 with a threshold of a detected intensity of carbon of 50 counts (cps).

Figure 4:
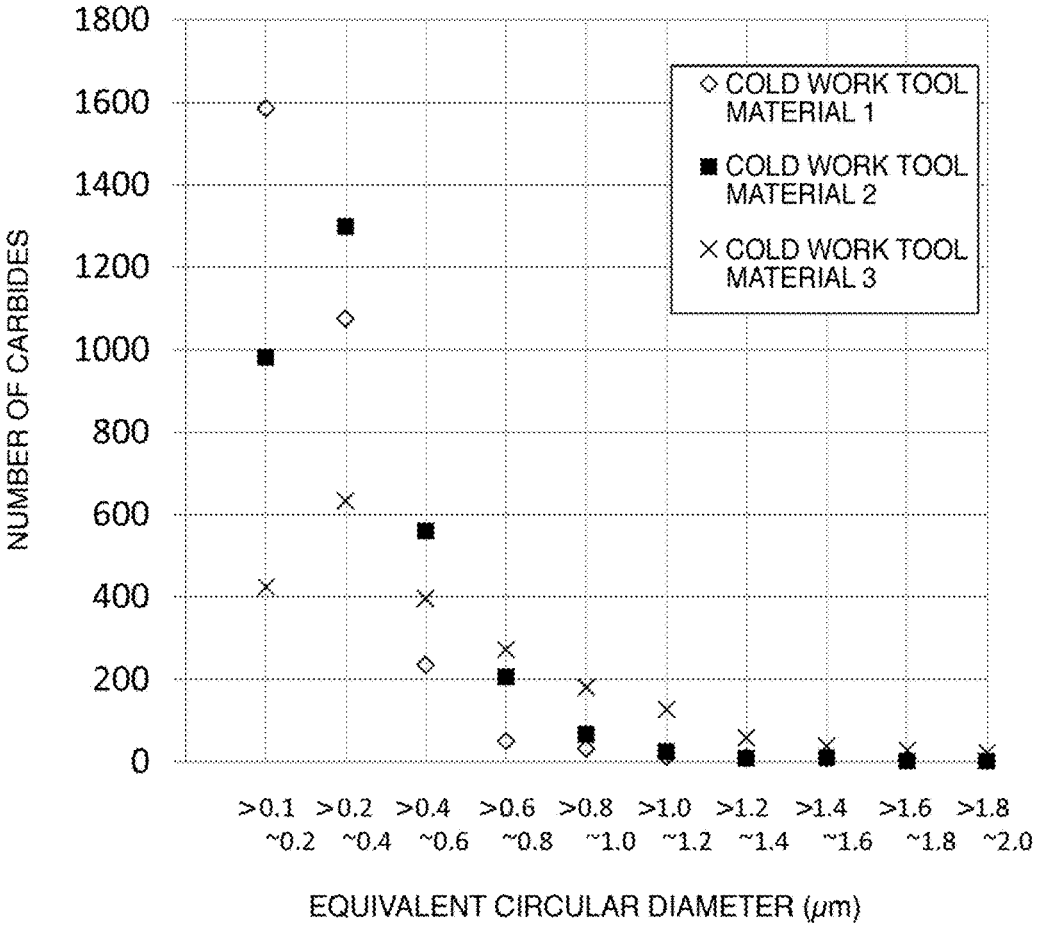
FIG. 4 is a graph illustrating the number of carbides (in ordinate axis) in relation to each range of equivalent circular diameter of carbides (in abscissa axis) with respect to distributed carbides in a region that does not include carbides having an equivalent circular diameter exceeding 5.0 in an example of a cross-sectional structure of cold work tool material according to examples of the present invention and comparative examples

The measured numbers of carbides A and B in the 30 μm*30 μm sections of three regions were summed to determine the numbers of carbides A and B for the cold work tool materials 1 to 3. The number densities of the carbides A and B and the number proportions between the carbides A and B were determined from the values. The results are shown in Table 3. FIG. 4 is a view plotting the numbers of carbides in the cold work tool materials 1 to 3 (in axis of ordinate) that were determined by the total of three regions, in relation to ranges of the equivalent circular diameter of the carbides (in abscissa axis). "Carbides having an equivalent circular diameter exceeding 5.0 μm" were not included in the regions of the cold work tool materials 1 to 3.

TABLE 3

| Cold Work Tool | Number density (1/mm$^2$) | | Proportion of Number of Carbides B to Number of Carbides | |
|---|---|---|---|---|
| Materials | Carbides A | Carbides B | A (%) | Remarks |
| 1 | 11.1 * $10^5$ | 9.9 * $10^5$ | 89.1 | Examples according to the invention |
| 2 | 11.7 * $10^5$ | 8.4 * $10^5$ | 71.8 | |
| 3 | 8.0 * $10^5$ | 3.9 * $10^5$ | 48.8 | Comparative example |

After the cross-sectional structures were observed, the cold work tool materials 1 to 3 were subjected to quenching from 1020° C., followed by tempering at a temperature of 100° C. to 540° C. to obtain cold work tools 1 to 3 having a martensitic structure, which corresponded to the cold work tool materials 1 to 3 respectively. A total of 10 conditions were adopted for the tempering temperatures, namely, low-temperature tempering conditions of 100° C., 200° C. and 300° C., and high-temperature tempering conditions of 450° C., 480° C., 490° C., 500° C., 510° C., 520° C. and 540° C. Subsequently, Rockwell hardness test (C scale) of the TD face was conducted for each tempering temperature sample of each cold work tool 1 to 3. The hardness was measured at five points for each sample, and an average thereof was determined. The hardness as well as dependence of the hardness on the tempering temperature (stability of the hardness) was evaluated. The results are shown in FIG. 5 for low-temperature tempering conditions and FIG. 6 for high-temperature tempering conditions.

Figure 5:
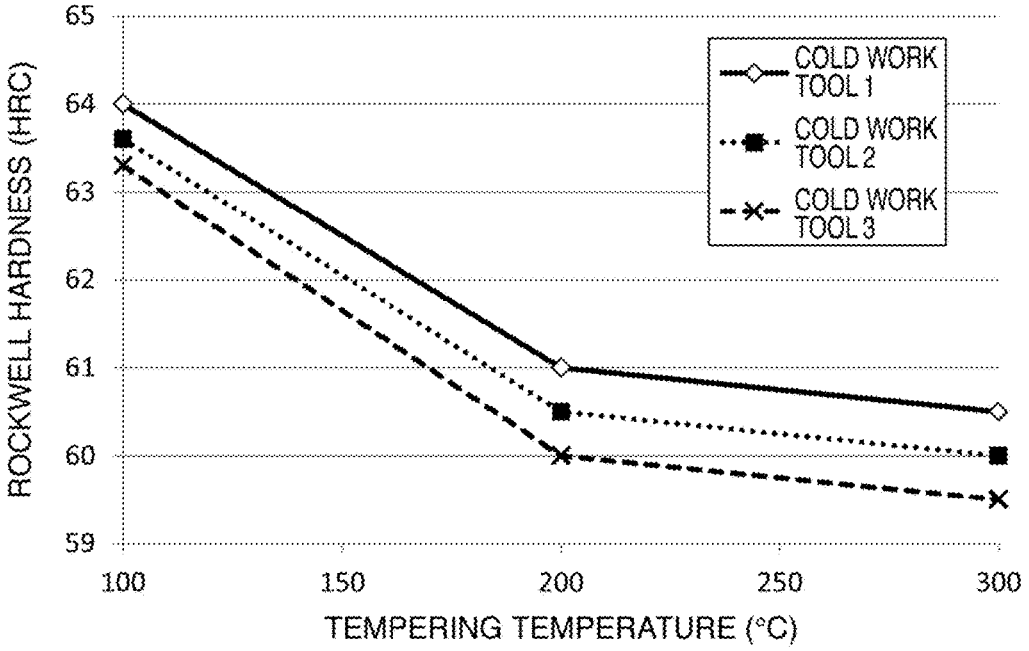
FIG. 5 is a graph showing hardness in relation to tempering temperatures of an example of a cold work tool tempered at low temperatures (100° C. to 300° C.) after quenched for the examples of the present invention and the comparative examples.
Figure 6:
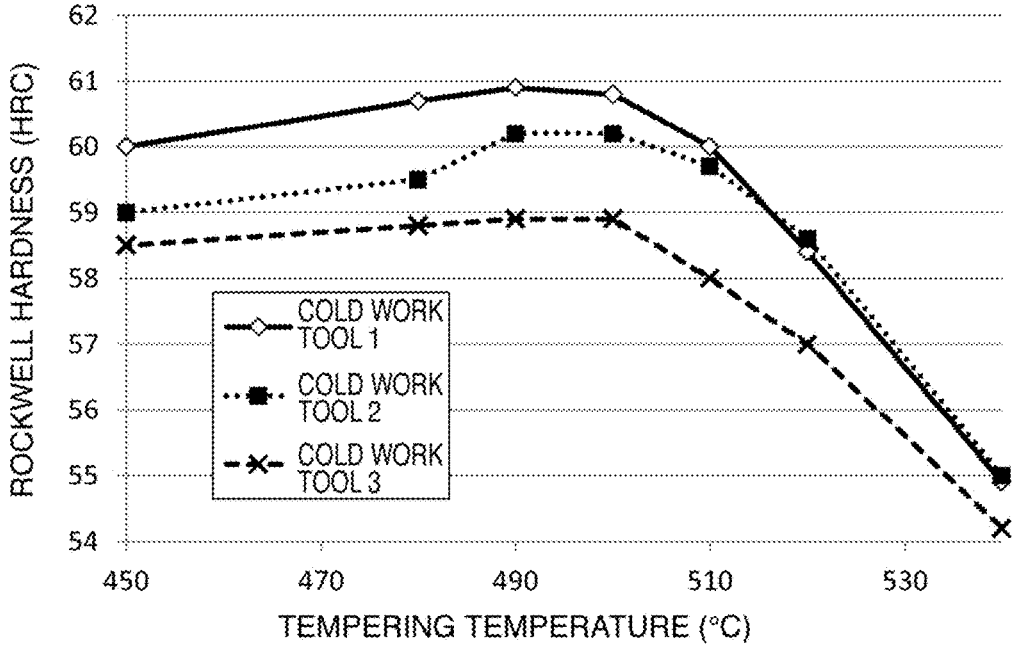
FIG. 6 is a graph showing hardness in relation to tempering temperatures of an example of a cold work tool tempered at high temperatures (450° C. to 540° C.) after quenched for the examples of the present invention and the comparative examples.

It is seen from FIGS. 5 and 6 that the cold work tools 1 and 2 according to the present invention had higher hardness, over a wide temperature range, than the cold work tool 3 of the comparative examples in both cases of low-temperature tempering (100° C. to 300° C.) and high-temperature tempering (450° C. to 540° C.). Particularly in the case of the high-temperature tempering, the cold work tools 1 and 2 according to the present invention could securely achieve high hardness of not less than 60 HRC that is required for a cold work tool in a wide range of the tempering temperatures of about 490° C. to 500° C., while the cold work tool 3 of the comparative example could not obtain the hardness at any of the applied tempering temperatures. Furthermore, the cold work tool 1 could achieve and maintain the hardness of not less than 60 HRC in a wide range of the tempering temperatures of 450° C. to 510° C. Furthermore, the cold work tools 1 and 2 could achieve the high hardness of not less than 60 HRC at two conditions of the tempering temperature 200° C. and 500° C. that are standard tempering temperatures for the cold work tool steel SKD10.

Example 2

Materials 4 and 5 having compositions shown in Table 4 were produced by casting molten steels (melting point: about 1420° C., solidification completing temperature: about 1200° C.) which had been adjusted to have the predetermined compositions. Herein, each of molten steels of the materials 4 and 5 were adjusted to have a temperature 1520° C. before poured into a casting mold. Cooling time periods passing a solid-liquid coexisting range after pouring the materials 1 to 3 into the casting molds were adjusted to 22 minutes for the material 4, and 183 minutes for the material 5, by changing the dimensions of the casting molds for the materials 4 and 5. Furthermore, cooling time periods of the solidified steel ingots (the materials) passing a temperature range from the solidification completing temperature to 800° C. were adjusted to 53 minutes for the material 4 and 267 minutes for the material 5.

For the materials 4 and 5, Cu, Al, Ti, Ca, Mg and O were not intentionally added to the materials (while Al was used as a deoxidizer in a melting process).

The contents of the elements were Cu≤0.25%; Al≤0.25%; Ti≤0.0300%; Ca≤0.0100%; Mg≤0.0100%; and O≤0.0100%. The Al contents in the materials 4 and 5 were 0.002%.

TABLE 4

| Material | C | Si | Mn | P | S | Ni | Cr | Mo | V | N | by mass % Fe* |
|---|---|---|---|---|---|---|---|---|---|---|---|
| 4 | 0.99 | 0.89 | 0.34 | 0.017 | 0.0002 | 0.22 | 6.33 | 3.15 | 0.34 | 0.0424 | Bal. |
| 5 | 0.99 | 0.92 | 0.32 | 0.020 | 0.0005 | 0.23 | 6.94 | 2.77 | 0.35 | 0.0111 | Bal. |

*Impurities are included.

Next, these materials were heated at 1100° C. and hot-worked. The hot-worked materials were allowed to be cooled, thereby obtaining steels 4 and 5, which correspond to the materials 4 and 5 respectively, having dimensions shown in Table 5. (A length direction of the steel in Table 5 was an extended direction by the hot working). Then, these steels were annealed at 860° C., thereby producing the cold work tool materials 4 and 5 (hardness: 248 HBW) which correspond to steels 4 and 5 respectively.

TABLE 5

| Steel | Dimension (mm) |
|---|---|
| 4 | diameter: 215, length: 1000 |
| 5 | diameter: 185, length: 1000 |

A cut section having a cross-sectional area of 15 mm*15 mm was taken from a TD face of each of the cold work tool materials 4 and 5. The TD face is parallel to the direction extended by the hot working (that is, the length direction of the material). The cut section was taken from a TD face positioned at ¼ of a diameter from the circumferential surface toward its center. The cut section was polished into a mirror surface with use of diamond slurry and colloidal silica. Next, three regions having a length of 90 μm and a width of 90 μm, which include no carbide having an equivalent circular diameter of more than 5.0 μm, were extracted from the structure of each polished cut section.

Figure 7:
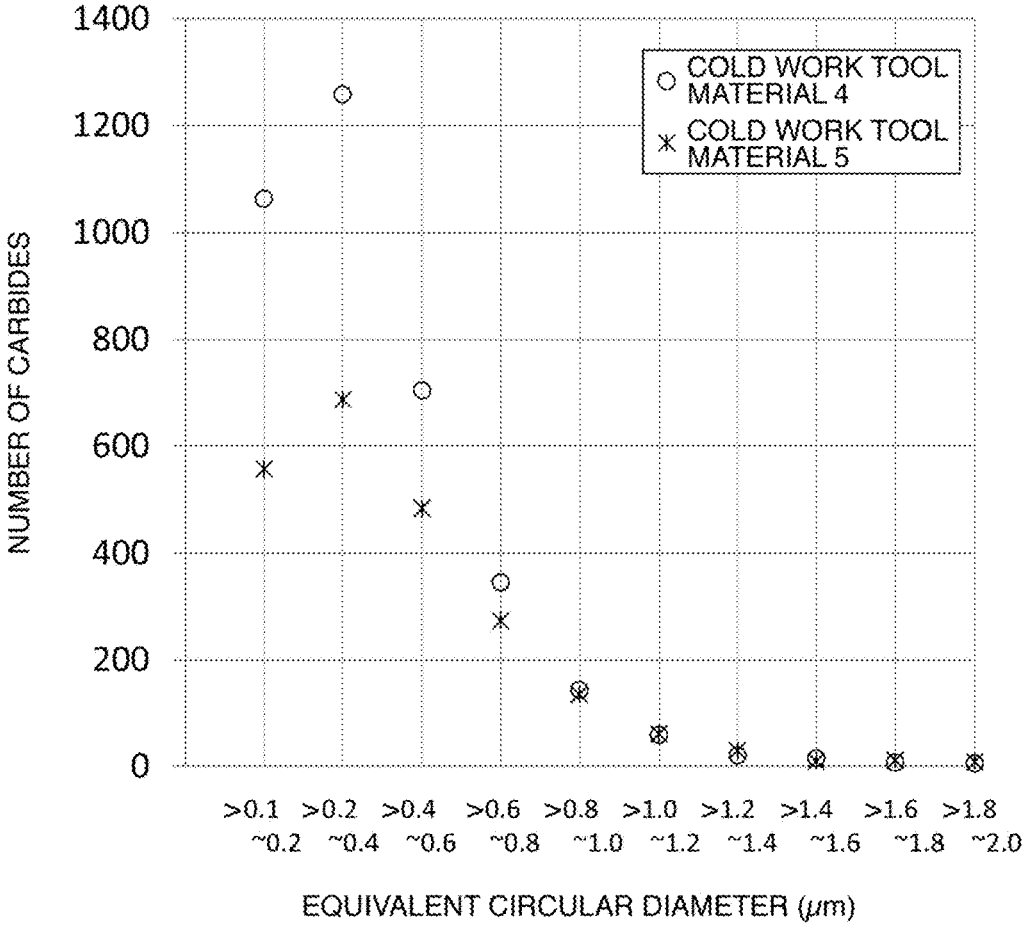
FIG. 7 is a graph illustrating the number of carbides (in ordinate axis) in relation to each range of equivalent circular diameters of carbides (in abscissa axis), for showing a distribution of carbides in a region that includes no carbide having an equivalent circular diameter of more than 5.0 μm, in examples of cross-sectional structures of cold work tool materials according to the example of the present invention and the comparative example.

Thereafter, the numbers of the carbides A and B in the sections of 30 μm*30 μm in the three regions were summed in the same manner as that of Example 1, to determine the numbers of carbides A and B for the cold work tool materials 4 and 5. The number densities of the carbides A and B and the number proportions between the carbides A and B were determined from the values. The results are shown in Table 6. FIG. 7 is a view plotting the numbers of the carbides in the cold work tool materials 4 and 5 (in axis of ordinate) that were determined by the total of three regions, in relation to ranges of the equivalent circular diameter of the carbides (in abscissa axis). The regions extracted in the cold work tool materials 4 and 5 did not include "carbides having an equivalent circular diameter of more than 5.0 μm".

TABLE 6

| Cold Work Tool | Number density ($1/mm^2$) | | Proportion of Number of Carbides B to Number of | |
|---|---|---|---|---|
| Materials | Carbides A | Carbides B | Carbides A (%) | Remarks |
| 4 | $13.4 * 10^5$ | $8.6 * 10^5$ | 64.2 | Examples according to the invention |
| 5 | $8.3 * 10^5$ | $4.6 * 10^5$ | 55.4 | Comparative example |

After the cross-sectional structures were observed, the cold work tool materials 4 and 5 were subjected to quenching from 1070° C., followed by tempering at a temperature of 100 to 540° C. to obtain cold work tools 4 and 5, which corresponded to the cold work tool materials 4 and 5 respectively, having a martensitic structure. A total of 10 conditions were adopted as the tempering temperatures, namely, low-temperature tempering conditions of 100° C., 200° C. and 300° C. and high-temperature tempering conditions of 450° C., 500° C., 520° C., 530° C., 540° C., 550° C. and 560° C. Subsequently, Rockwell hardness test (C scale) of the TD face was conducted for each tempering temperature sample of each cold work tool 4 and 5. The hardness was measured at five points of each sample, and an average thereof was determined. The hardness as well as dependence of the hardness on the tempering temperature (stability of the hardness) was evaluated. The results are shown in FIGS. 8 and 9 for low-temperature tempering and high-temperature tempering respectively.

Figure 8:
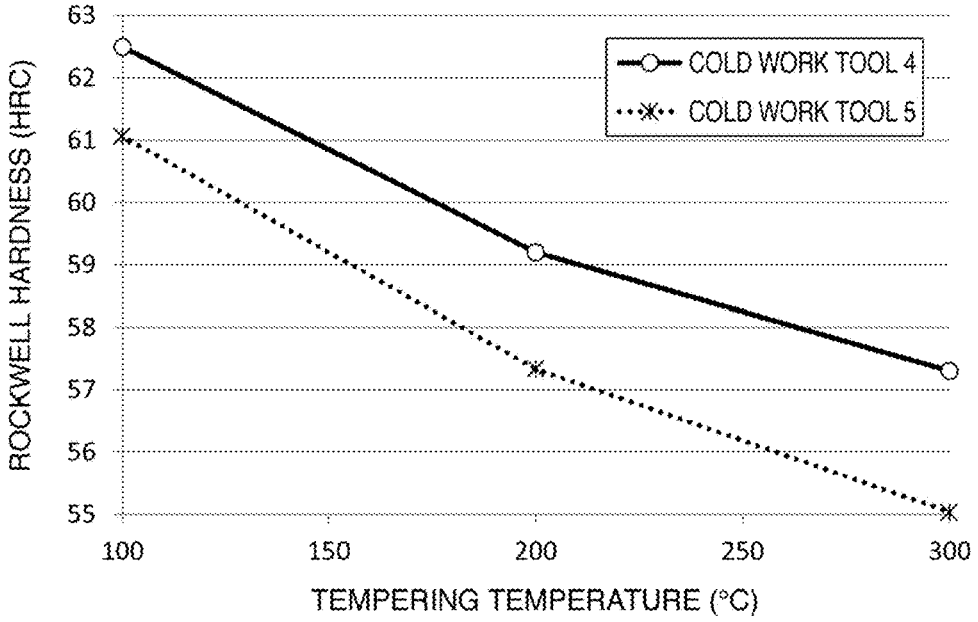
FIG. 8 is a graph showing hardness in relation to tempering temperatures of an example of a cold work tool tempered at low temperatures (100° C. to 300° C.) after quenched for the examples of the present invention and the comparative examples.
Figure 9:
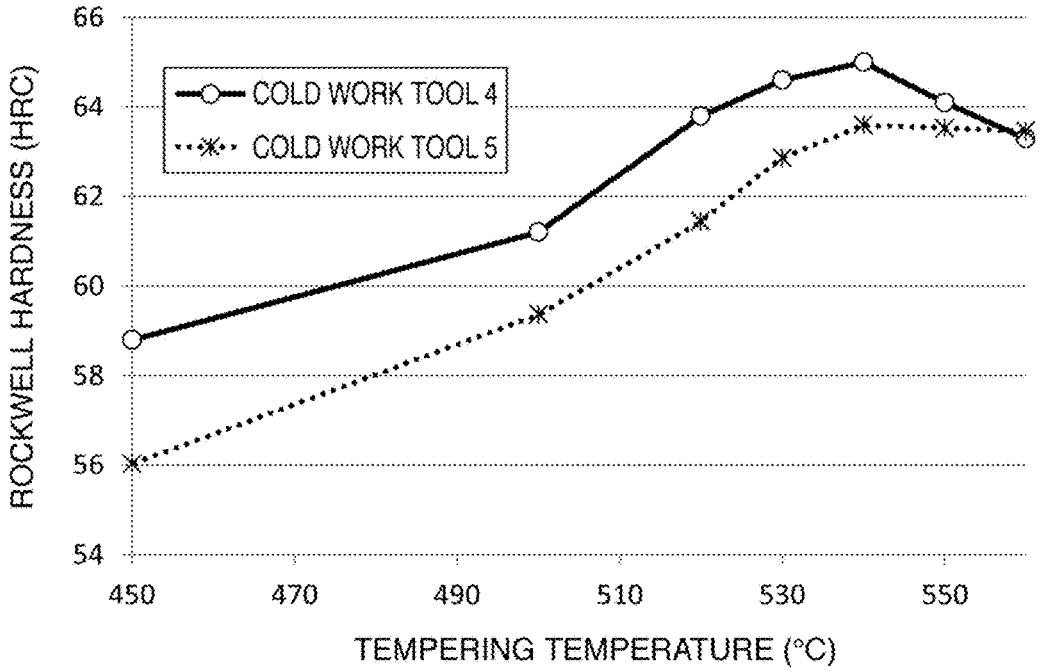
FIG. 9 is a graph showing hardness in relation to tempering temperatures of an example of a cold work tool tempered at high temperatures (450° C. to 540° C.) after quenched for the examples of the present invention and the comparative examples.

It is seen from FIGS. 8 and 9 that the cold work tool 4 according to the present invention has higher hardness, over a wide temperature range, than the cold work tool 5 of the comparative examples in both cases of low-temperature tempering (100 to 300° C.) and high-temperature tempering (450° C. to 560° C.). Particularly in the case of the high-temperature tempering, the cold work tool 4 according to the present invention could securely achieve and maintain high hardness of not less than 60 HRC that is required for a cold work tool in a wide range of the tempering temperatures of not lower than 500° C. Furthermore, the cold work tool 4 could achieve the high hardness of 65 HRC at a tempering temperature of 540° C.

The invention claimed is:

1. A cold work tool material having a steel composition including, by mass %, C: 0.65% to 2.40%, Cr: 5.0% to 15.0%, Mo and W alone or in combination in an amount of (Mo+½W): 0.50% to 4.00%, V: 0.10% to 1.50%, N: more than 0.0300% and not more than 0.0800%, Si: not more than 2.00%, Mn: not more than 1.50%, P: not more than 0.050%, S: not more than 0.0500%, Ni: 0% to 1.00%, Nb: 0% to 1.50%, Cu: 0% to 0.25%, and the balance being Fe and impurities, wherein the material includes a cross sectional region of a structure, the region having a length of 90 μm and a width of 90 μm and including no carbides having an equivalent circular diameter exceeding 5.0 μm, and wherein, in the cross sectional region, a number density of carbides A having an equivalent circular diameter of more than 0.1 μm and not more than 2.0 μm is not less than $9.0\times10^5/mm^2$, and a number density of carbides B having an equivalent circular diameter of more than 0.1 μm and not more than 0.4 μm is not less than $7.5\times10^5/mm^2$.

2. The cold work tool material according to claim 1, wherein a proportion of the number of the carbides B to the number of the carbides A is not less than 65.0% in the cross sectional region.

3. A method of manufacturing a cold work tool, comprising a step of quenching and tempering the cold work tool material according to claim 1.

4. A method of manufacturing a cold work tool, comprising a step of quenching and tempering the cold work tool material according to claim 2.

* * * * *